US009242479B2

(12) United States Patent
Ishizuka

(10) Patent No.: US 9,242,479 B2
(45) Date of Patent: Jan. 26, 2016

(54) LIQUID DISCHARGE DEVICE AND MEDIA PRETREATMENT METHOD

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/625,202

(22) Filed: Feb. 18, 2015

(65) Prior Publication Data

US 2015/0239264 A1 Aug. 27, 2015

(30) Foreign Application Priority Data

Feb. 25, 2014 (JP) ..... 2014-034365

(51) Int. Cl.

| | |
|---|---|
| ***B41J 2/01*** | (2006.01) |
| ***D06P 5/00*** | (2006.01) |
| ***D06P 5/20*** | (2006.01) |
| ***D06P 5/30*** | (2006.01) |
| ***B41J 11/00*** | (2006.01) |
| ***B41M 5/00*** | (2006.01) |
| ***B41J 3/407*** | (2006.01) |
| ***B41J 15/04*** | (2006.01) |

(52) U.S. Cl.

CPC ..... *B41J 11/0015* (2013.01); *B41J 2/01* (2013.01); *B41J 3/4078* (2013.01); *B41J 11/007* (2013.01); *B41J 15/048* (2013.01); *B41M 5/0011* (2013.01); *D06P 5/00* (2013.01); *D06P 5/20* (2013.01); *D06P 5/30* (2013.01)

(58) Field of Classification Search

USPC ..... 347/104, 105

See application file for complete search history.

(56) References Cited

U.S. PATENT DOCUMENTS

| | | | | |
|---|---|---|---|---|
| 2,729,192 | A * | 1/1956 | Warner | 118/117 |
| 3,338,211 | A * | 8/1967 | Nugarus | 118/261 |
| 5,867,197 | A * | 2/1999 | Aoki | 347/106 |
| 2005/0206711 | A1* | 9/2005 | Milini | 347/104 |
| 2006/0132575 | A1* | 6/2006 | Fukuda | 347/104 |

(Continued)

FOREIGN PATENT DOCUMENTS

| | | | |
|---|---|---|---|
| DE | 10 2012 101 872 | A1 | 9/2012 |
| EP | 1577101 | A2 | 1/2005 |
| EP | 2754559 | A1 | 7/2014 |

(Continued)

OTHER PUBLICATIONS

Computer-generated translation of JP 08-311782, published on Nov. 1996.*

(Continued)

*Primary Examiner* — Huan Tran

(74) *Attorney, Agent, or Firm* — Global IP Counselors, LLP

(57) ABSTRACT

The liquid discharge device is equipped with a conveyance belt configured to have a medium stuck to an adhesive layer of its surface and convey the medium, a pressure roller configured to stick the medium to the conveyance belt, and an attachment part provided at an upstream position to the pressure roller in a movement path of the conveyance belt and configured to adhere a pretreatment liquid to the conveyance belt. The medium is stuck using the pressure roller to the conveyance belt in a state with the pretreatment liquid L adhered. Alternatively, the medium is stuck to the conveyance belt using the pressure roller in a state with the pretreatment liquid adhered.

8 Claims, 7 Drawing Sheets

(56) References Cited

U.S. PATENT DOCUMENTS

| | | | | |
|---|---|---|---|---|
| 2009/0167833 | A1 | 7/2009 | Mochizuki | |
| 2014/0193187 | A1 * | 7/2014 | Ishizuka | 400/618 |

FOREIGN PATENT DOCUMENTS

| | | | | |
|---|---|---|---|---|
| JP | 08-311782 | * | 11/1996 | D06P 5/00 |
| JP | 08-311782 | A | 11/1996 | |
| JP | 2006-231557 | A | 9/2006 | |
| JP | 2009-173443 | A | 8/2009 | |
| JP | 2013-019083 | A | 1/2013 | |

OTHER PUBLICATIONS

The Extended European Search Report for the corresponding European Application No. 15156592.6 dated Jun. 22, 2015.

* cited by examiner

LIQUID DISCHARGE DEVICE AND MEDIA PRETREATMENT METHOD

CROSS-REFERENCE TO RELATED APPLICATIONS

This application claims priority to Japanese Patent Application No. 2014-034365 filed on Feb. 25, 2014. The entire disclosure of Japanese Patent Application No. 2014-034365 is hereby incorporated herein by reference.

BACKGROUND

1. Technical Field

The present invention relates to a liquid discharge device equipped with a conveyance belt that has media stuck to an adhesive layer on its surface and conveys it, and a pressure roller that sticks the media to the conveyance belt, and a media pretreatment method that is executed when using that liquid discharge device.

2. Related Art

As devices that perform recording on fabric such as cotton, silk, polyester or the like, screen recording devices and roller recording devices for which each color plate is prepared for each pattern to be printed have been widely used from the past. Also, in recent years, in response to digitalization, since it is possible to print on fabric without plates, inkjet recording devices that are able to handle production of a wide variety of items in small volume are rapidly becoming popular.

For this kind of inkjet recording device, there are inkjet recording devices equipped with a conveyance belt that has media stuck to the adhesive layer of its surface, and a pressure roller that sticks the media to the conveyance belt.

Also, for the inkjet recording devices, there are items constituted equipped with a pretreatment unit for performing pretreatment ahead of recording at an upstream position to the recording unit that performs recording on fabric as one example of the media as shown in Unexamined Patent Publication No. H08-311782 noted below.

Disclosed in Unexamined Patent Publication No. H08-311782 is an inkjet fabric recording device for which each constitutional member is arranged clearly divided in the sequence of the roll maintaining unit, the pretreatment unit, the adjustment unit, the recording unit, the adjustment unit, and the post treatment unit according to the flow of the fabric conveyance.

However, a device for which each constitutional member is arranged clearly divided for each step as shown with Unexamined Patent Publication No. H08-311782 becomes longer and larger, and it is not possible to provide an efficiently arranged, compact liquid discharge device.

Also, with the pretreatment unit in Unexamined Patent Publication No. H08-311782, there is only coating of the pretreatment liquid with a roller, so it is difficult to have the pretreatment liquid penetrate deeply into the interior of the fabric, and variation occurs in terms of recording quality.

SUMMARY

An object of the present invention is to make it easy for a pretreatment liquid to penetrate media with a liquid discharge device constituted to discharge liquid while sticking media to the surface of the conveyance belt and conveying it.

The liquid discharge device of the first mode of the invention comprises a conveyance belt configured to stick a medium on an adhesive layer of a surface of the conveyance belt and convey the medium, a pressure roller configured to stick the medium to the conveyance belt, and an attachment part provided at an upstream position relative to the pressure roller in a movement path of the conveyance belt and configured to adhere a pretreatment liquid to the conveyance belt. The medium is stuck using the pressure roller to the conveyance belt in a state with the pretreatment liquid adhered.

The liquid discharge device of the second mode of the invention comprises a conveyance belt configured to stick a medium on an adhesive layer of a surface of the conveyance belt and convey the medium, a pressure roller configured to stick the medium to the conveyance belt, and an attachment part configured to adhere a pretreatment liquid to the pressure roller. The medium is stuck on the conveyance belt using the pressure roller in a state with the pretreatment liquid adhered.

The liquid discharge device of the third mode of the invention according to the first mode further comprises a belt arranged between the attachment part and the pressure roller in the movement path of the conveyance belt, and the blade is configured to be in sliding contact on the surface of the conveyance belt.

The liquid discharge device of the fourth mode of the invention according to the second mode further comprises a blade arranged between a pretreatment liquid adhesion position and a sticking position of the medium on a circumferential surface of the pressure roller, and the blade is configured to be in sliding contact on the pressure roller.

The liquid discharge device of the fifth mode of the invention according to the mode of any of the first through fourth modes further comprises a liquid discharge unit arranged discharge a liquid on the medium and arranged at a downstream position to the pressure roller in the movement path of the conveyance belt, and a heater configured to heat the pretreatment liquid adhered to the medium and arranged between the pressure roller and the liquid discharge unit.

In the liquid discharge device of the sixth mode of the invention according to any of the first through fifth modes, a pressure force of the pressure roller is adjustable.

In the liquid discharge device of the seventh mode of the invention according to the third or fourth mode, an action position of the blade can is adjustable.

The media pretreatment method of the eighth mode of the invention comprises, when a medium that is stuck to a surface of a conveyance belt is conveyed and sent to a liquid discharge area, sticking the medium using a pressure roller to the conveyance belt in a state with a pretreatment liquid adhered.

The media pretreatment method of the ninth mode of the present invention comprises, when a medium is stuck to a surface of a conveyance belt is conveyed and sent to a liquid discharge area, sticking the medium to the conveyance belt using a pressure roller in a state with a pretreatment liquid adhered.

With the present invention, it is possible to make it easier for pretreatment liquid to penetrate medium with a liquid discharge device constituted to discharge liquid while sticking medium to the surface of the conveyance belt and conveying it.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
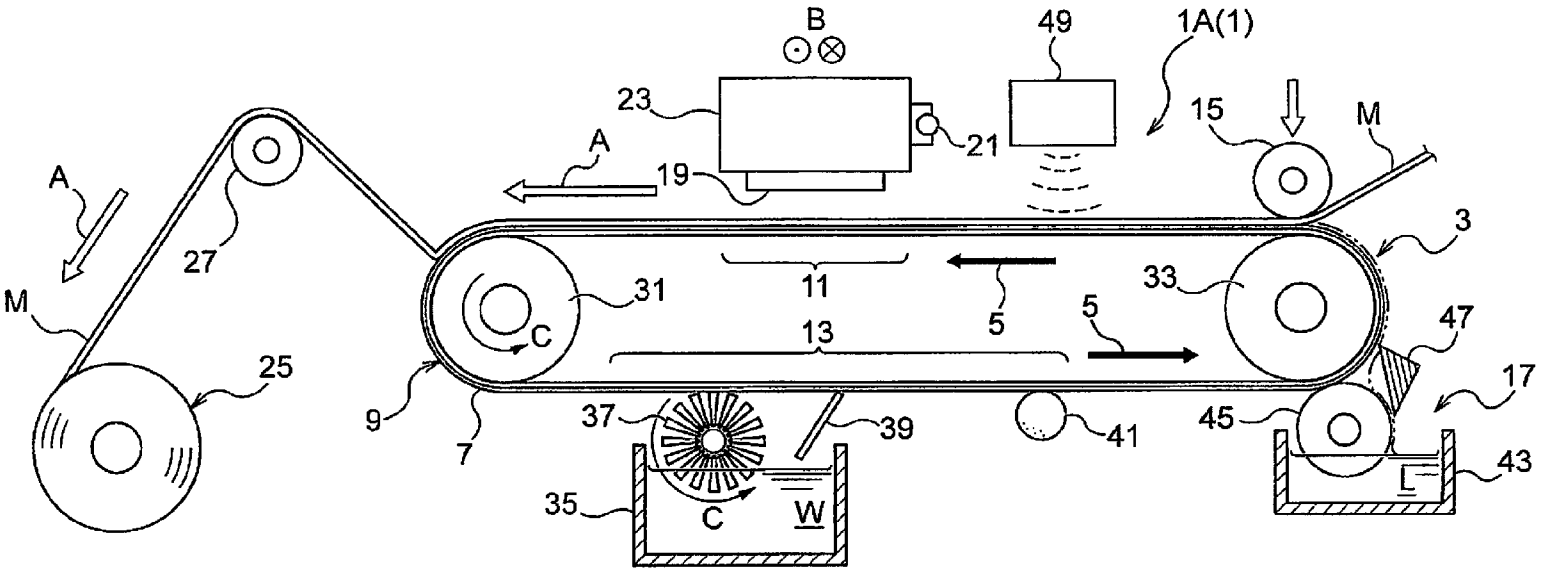
FIG. 1 is a schematic side view showing the liquid discharge device of embodiment 1 of the present invention.

Following, we will give a detailed description of the liquid discharge device and the media pretreatment method of the present invention while referring to the attached drawings.

With the description below, using five embodiments of embodiments 1 through 5 as examples, initially based on embodiment 1, we will describe the specific constitution and action mode of the pressure roller and the pretreatment liquid attachment part that are characteristic constitutions of the present invention. Next, we will describe in sequence the constitution and action mode of the liquid discharge device of embodiment 2 and the constitution and action mode of the liquid discharge device of embodiment 3 with a focus on the differences from embodiment 1.

Furthermore, we will give a specific description of the media pretreatment method of the present invention using embodiments 4 and 5 as examples.

Figure 2:
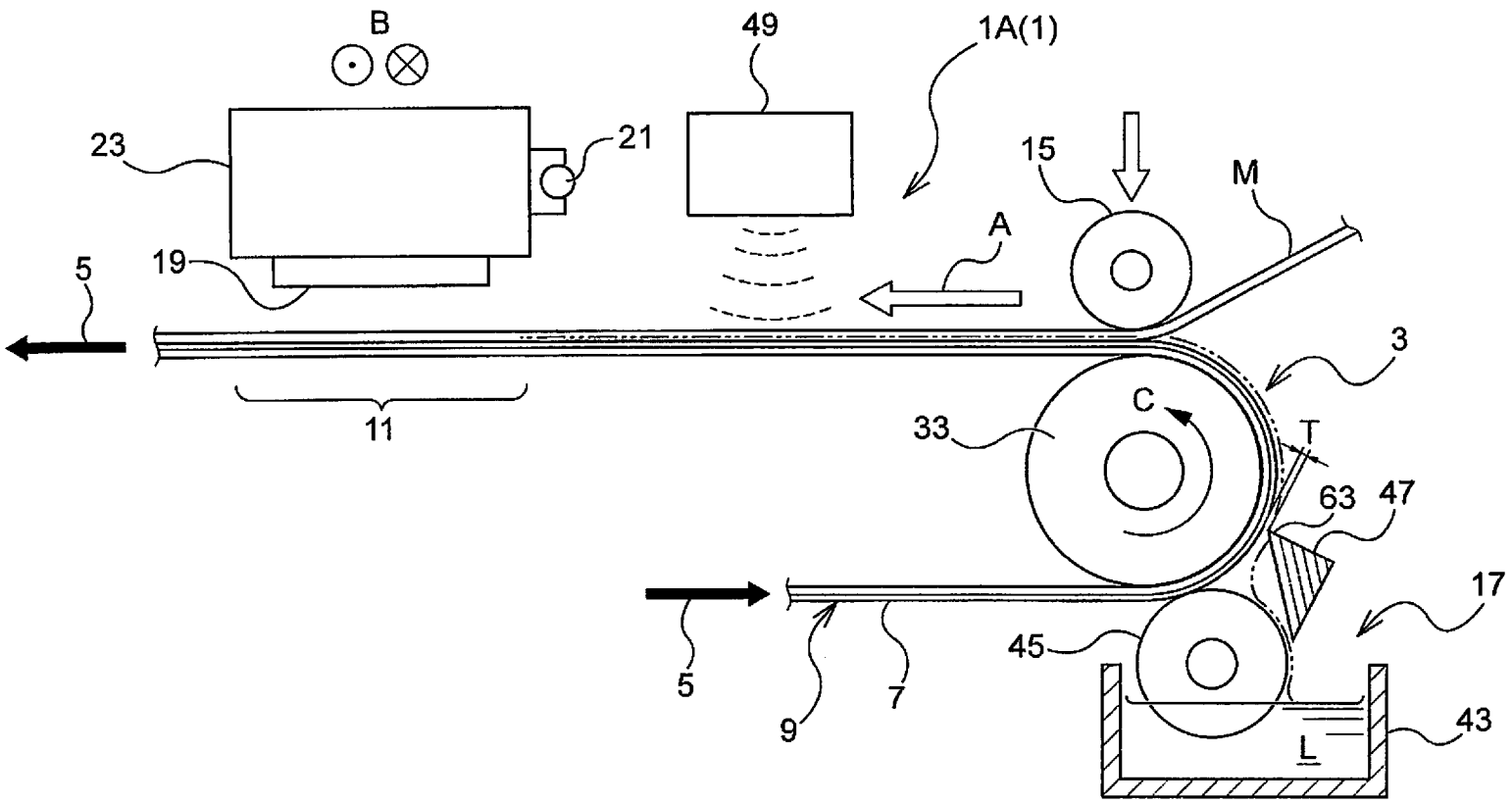
FIG. 2 is an enlarged side view showing the key parts of the liquid discharge device of embodiment 1 of the present invention.
Figure 3:
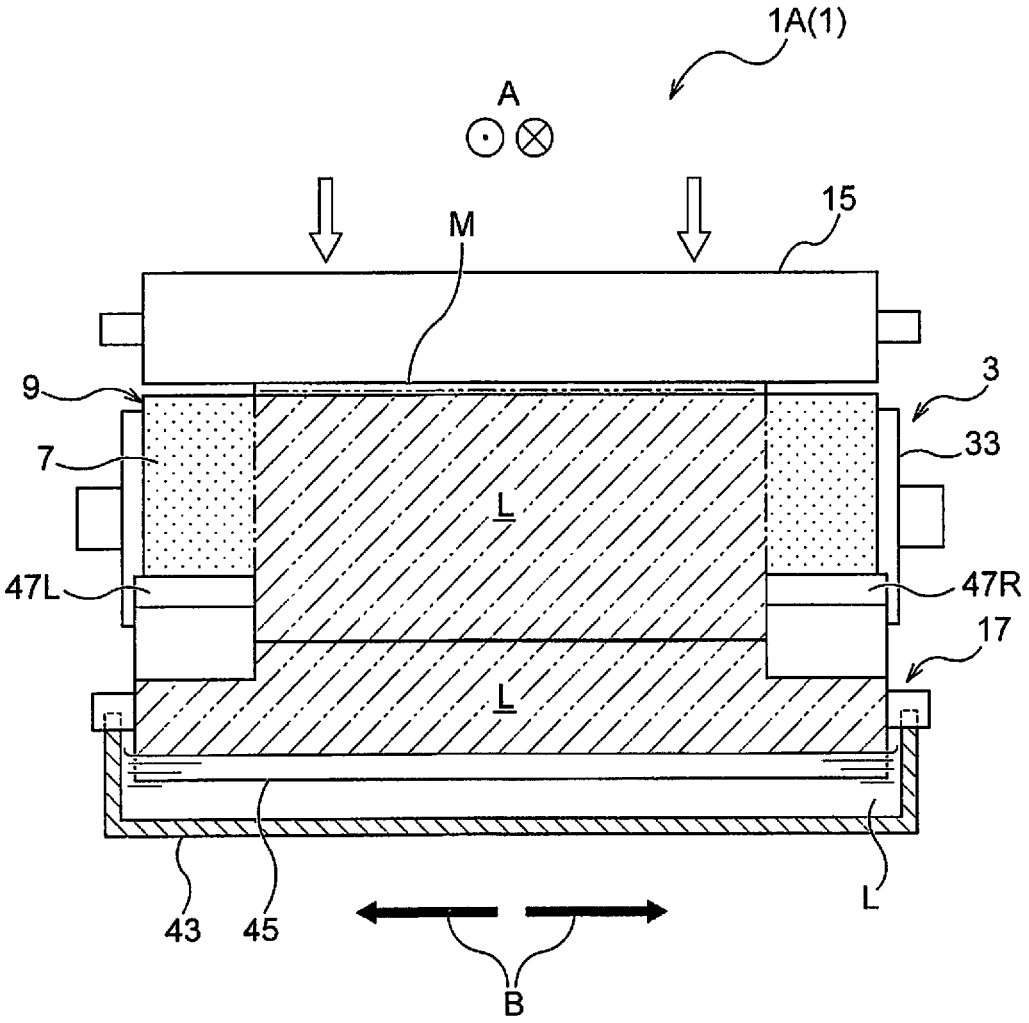
FIG. 3 is a front view from the conveying upstream side showing the state of pretreatment liquid adhered to the conveyance belt of the liquid discharge device of embodiment 1 of the present invention.

Embodiment 1 (See FIG. 1 to FIG. 3)

The liquid discharge device 1 of embodiment 1 of the present invention is equipped with a media conveyance unit 3 which has a conveyance belt 9 that sticks a media M on an adhesive layer 7 of its surface and conveys it, a pressure roller 15 that sticks the media M on the conveyance belt 9, and an attachment part 17 provided at an upstream position to the pressure roller 15 in a movement path 5 of the conveyance belt 9 and adheres a pretreatment liquid L to the conveyance belt 9. Also, the constitution is such that the media M is stuck using the pressure roller 15 to the conveyance belt 9 in a state with pretreatment liquid 9 adhered.

(1) Overall Schematic Constitution of the Liquid Discharge Device (See FIG. 1)

First, we will describe the schematic constitution of the liquid discharge device 1A of this embodiment 1 based on FIG. 1.

The liquid discharge device 1A shown in FIG. 1 is an inkjet recording device that uses fabric as the media M. Here, "fabric" is a natural fiber such as cotton, hemp, silk or the like, a chemical fiber such as nylon, polyester or the like, or a fiber product such as a cloth, textile or the like using a mixture of these as the source thread.

Also, in addition to the constitutional members described previously, provided on this liquid discharge device 1A, in a liquid discharge area 11 in the movement path 5 of the conveyance belt 9, are a liquid discharge head 19 which is the liquid discharge unit for discharging ink, which is an example of the liquid, on the surface to be discharged on of the media M sent to the liquid discharge area 11 for execution of recording, and a carriage 23 for moving back and forth the liquid discharge head 19 as an example in a width direction B orthogonal to a conveyance direction A of the media M along a carriage guide shaft 21 in a state placed on the bottom surface. Furthermore, downstream to the liquid discharge area 11, arranged are a winding unit 25 that winds the media M peeled from the conveyance belt 9 after execution of the recording, and a guide roller 27 at an upstream position to the winding unit 25.

Also, in a washing area 13 in the movement path 5 of the conveyance belt 9, arranged in sequence facing from upstream to downstream in the belt movement direction, are a washing brush 37 for removing ink and the like that is adhered to the surface of the conveyance belt 9 using a washing liquid W stored in a washing container 3, a blade 39 for scraping the droplets of washing liquid W from the surface of the conveyance belt 9, and a wiping roller 41 for further wiping the surface of the conveyance belt 9 for which droplets have been scarped by the blade 39.

Instead of the wiping roller 41, it is also possible to arrange a heater for drying the surface of the conveyance belt 9.

The media conveyance unit 3 is constituted by being equipped with an endless belt conveyance belt 9 conveyed by being circulated through the liquid discharge area 11, a drive roller 31 that transmits drive force of rotation direction C as an example to the conveyance belt 9, and a driven roller 33 arranged separated from the drive roller 31, with the conveyance belt 9 stretched across and held on this together with the drive roller 31, with the conveyance belt 9 in a wound state.

With embodiment 1 shown in the drawing, the drive roller 31 is arranged at a downstream position in the conveyance direction A of media M as an example, and the driven roller 33 is arranged at an upstream position in the conveyance direction A of the media M as an example. Also, the adhesive layer 7 described previously for sticking the media M is provided on the surface which is the side opposite to the drive roller 31 of the endless belt conveyance belt 9.

(2) Specific Constitution and Action Mode of the Pressure Roller and the Pretreatment Liquid Attachment Part (See FIG. 2 and FIG. 3)

The pressure roller 15 is used for sticking the media M on the surface of the conveyance belt 9. This pressure roller 15 is pressed against the conveyance belt 9 by a designated pressure force (e.g. a force of approximately 98 N to a belt width of 1 m for the conveyance belt 9). Also, when the media M supplied between both items using that pressure force is stuck to the surface of the conveyance belt 9, adhesion and impregnation of the pretreatment liquid L to the media M is executed.

The pressure force of the pressure roller 15 can be adjusted to be changed as appropriate according to the belt width or the like of the conveyance belt 9.

The attachment part 17 is constituted as an example by being equipped with a storage container 43 that stores the pretreatment liquid L, and a coating roller 45 that has a portion of the pretreatment liquid L inside the storage container 43 impregnated, and is provided in a state in contact with the surface of the conveyance belt 9 and able to be driven and rotated by it.

Also, with this embodiment 1, the attachment part 17 is provided at a position in which the driven roller 33 of the media conveyance unit 3 described previously is arranged as shown in FIG. 2, in a state with the conveyance belt 9 sandwiched between the coating roller 45 and the driven roller 33.

Also, with this embodiment 1, as shown in FIG. 1 and FIG. 2, a blade 47 is provided in sliding contact on the surface of the conveyance belt 9 between the attachment part 17 and the pressure roller 15 in the movement path 5 of the conveyance belt 9 as shown in FIG. 1 and FIG. 2.

This blade 47 can be constituted with one long blade extending the full length of the pressure roller 15, or can be constituted with one or a plurality of blades (47L, 47R) arranged only at necessary locations corresponding to the width dimension or the like of the used media M as shown in FIG. 3 (with the embodiment in the drawing, two locations in the range of a designated length including the left and right side edges of the conveyance belt 9).

Also, it is possible to set the coating thickness of the pretreatment liquid L using a gap T between a contact piece 63 of the tip of this blade 47 and the surface of the conveyance belt 9, and by adjusting this gap T, it is possible to obtain a suitable coating thickness of the pretreatment liquid L to match the used media M.

Furthermore, with this embodiment 1, a heater 49 for heating and drying the pretreatment liquid L adhered to and impregnated in the media M is provided between the pressure roller 15 and the liquid discharge head 19, and using this heater 49, it is possible to prompt fixing of the pretreatment liquid L on the media M, and to execute good recording on the liquid discharge area 11.

With the liquid discharge device 1A of this embodiment 1 constituted in this way, each constitutional member such as the attachment part 17, the blade 47, the pressure roller 15, the heater 49, the liquid discharge head 19 and the like are efficiently arranged along the movement path 5 of the conveyance belt 9 formed in a loop shape, so it is possible to prevent the device from becoming longer and larger, and to provide a compact liquid discharge device.

Also, by the action of the pressure roller 15 and the attachment part 17 which are characteristic constitutions of the present invention, it is possible for the pretreatment liquid L to deeply penetrate the interior of the media M, and thus possible to stably maintain good recording quality.

Figure 4:
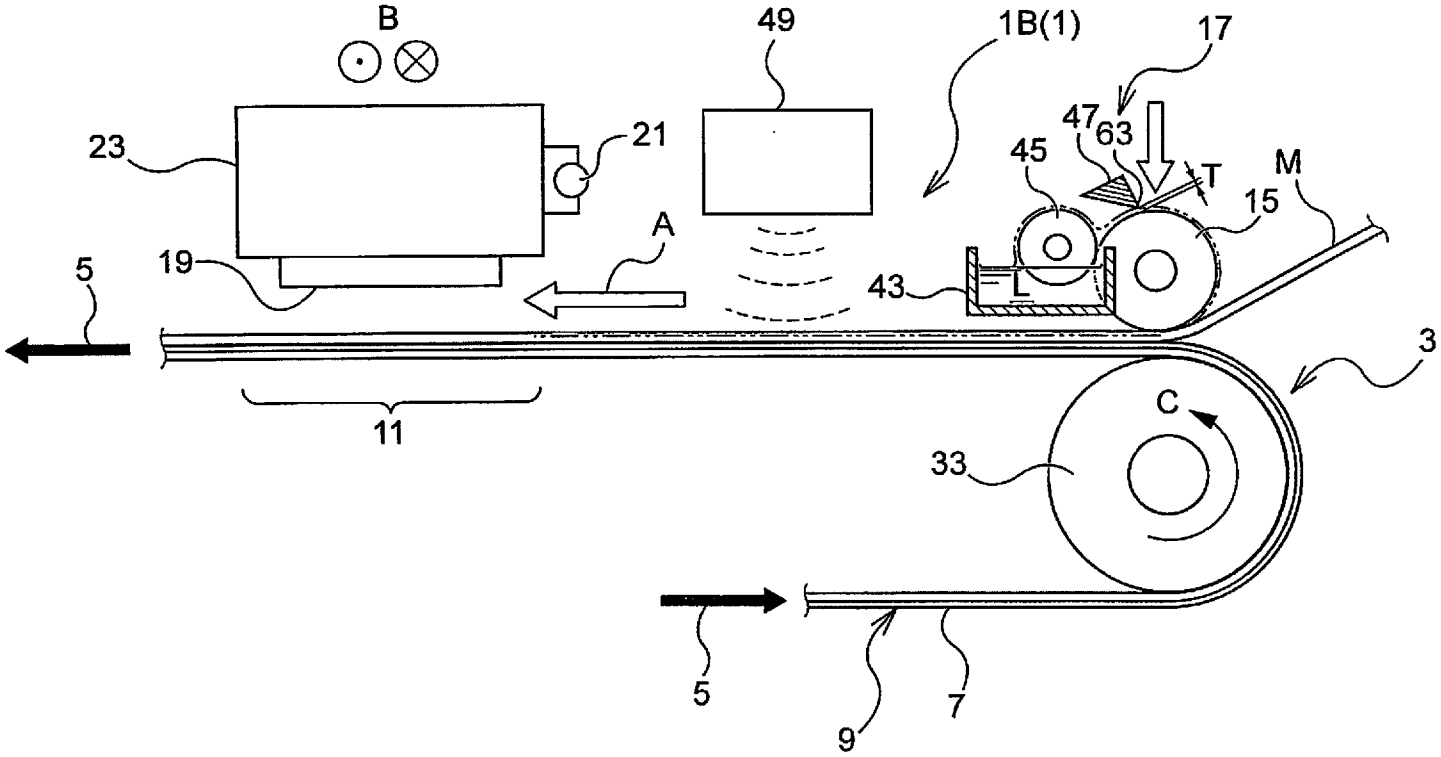
FIG. 4 is an enlarged side view showing the key parts of the liquid discharge device of embodiment 2 of the present invention.
Figure 5:
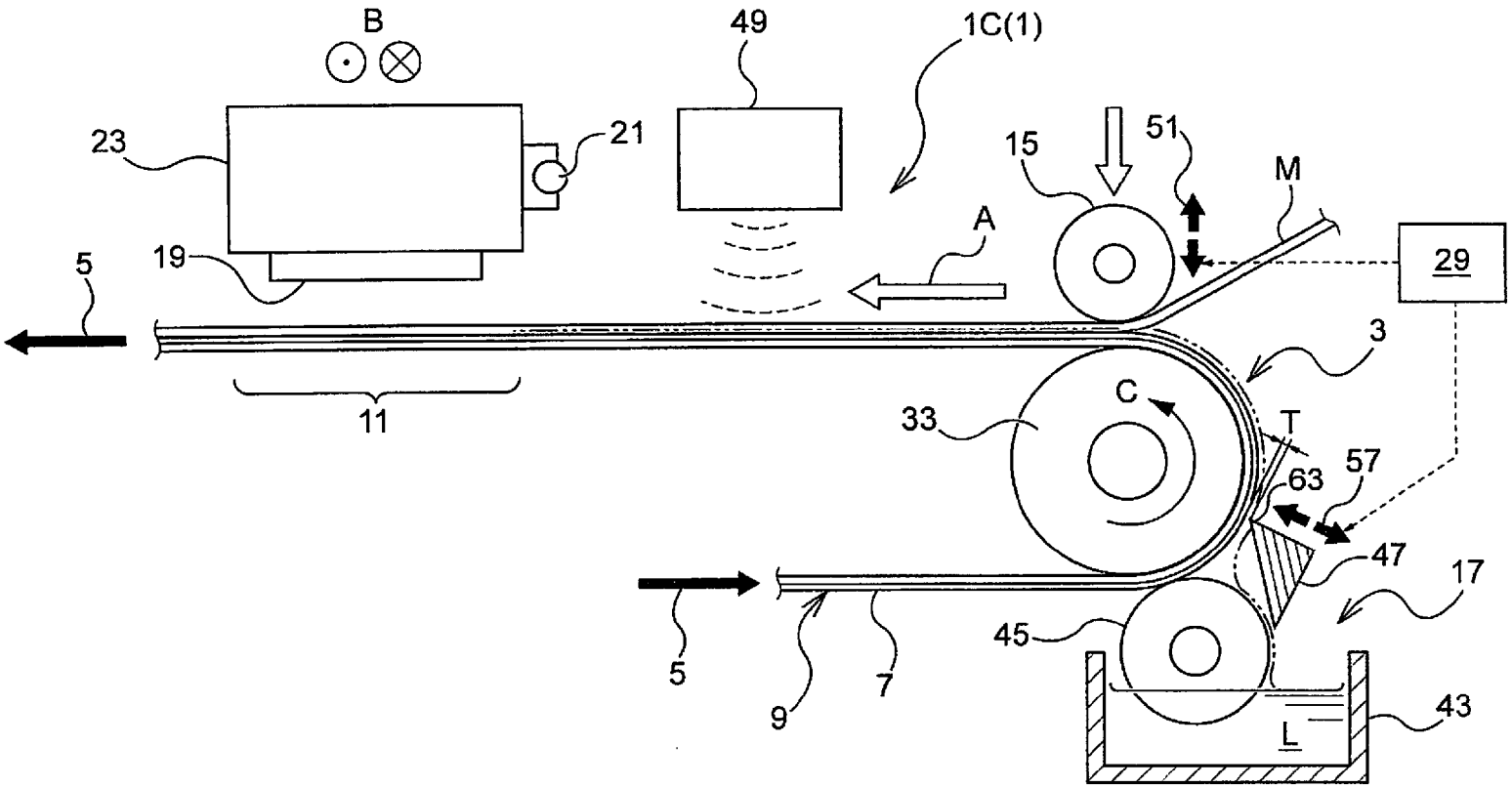
FIG. 5 is an enlarged side view showing the key parts of the liquid discharge device of embodiment 3 of the present invention.

Embodiment 2 (See FIG. 4)

The liquid discharge device 1B of embodiment 2 only differs in terms of the arrangement of the attachment part 17 and the blade 47, and the remainder of the constitution is the same as that of the liquid discharge device 1A of embodiment 1. Therefore, here, we will omit a description of the same constitution as that of embodiment 1, and will describe with a focus on the action and effects of the constitution newly used for embodiment 2.

Specifically, with embodiment 2, the arrangement of the attachment part 17 is moved from the area near the driven roller 33 with the media conveyance unit 3 to the area near the pressure roller 15. Therefore, the pretreatment liquid L stored inside the storage container 43 of the attachment part 17 is initially adhered to the circumferential surface of the pressure roller 15 by the coating roller 45.

Also, when sticking the media M to the surface of the conveyance belt 9 using the pressure roller 15, the pretreatment liquid L adhered to the pressure roller 15 adheres to the media M, and the constitution is such that it penetrates and is impregnated inside the media M by the pressure force of the pressure roller 15.

Also, the blade 47 which is in sliding contact with the surface of the pressure roller 15 is provided between the adhesion position of the pretreatment liquid L on the circumferential surface of the pressure roller 15, and the media M sticking position.

Also, with the liquid discharge device 1B of this embodiment 2 constituted in this way as well, it is possible to enjoy the same action and effects as those of the liquid discharge device 1A of embodiment 1 described previously, and also with this embodiment 2, it is possible to use the pretreatment liquid L not only as a penetrant but also as a coating liquid, and when using the pretreatment liquid L as a coating liquid, the coloring of the ink discharged on the media M is better, and it is possible to form vivid recorded images.

Embodiment 3 (See FIG. 5 and FIGS. 6A-6D)

The liquid discharge device 1C of embodiment 3 has a constitution for which it is possible to adjust the pressure force of the pressure roller 15, and possible to adjust the action position of the blade 47, and also equipped with a control unit 29 for controlling these adjustments. The remainder of the constitution is the same as that of the liquid discharge device 1A of embodiment 1 described previously.

Therefore, here, we will omit a description of the same constitution as that of embodiment 1, and will describe with a focus on the action and effects of the constitution newly used for embodiment 3.

Specifically, with this embodiment 3, the constitution is such that it is possible to adjust the pressure force of the pressure roller 15 by a pressure force adjustment mechanism 51. The pressure force of the pressure roller 15 can be suitably adjusted according to a difference in the width dimension of the media M, a difference in the thickness of the media M or the like so as to be approximately 98 N when the width dimension of the media M is 1 m and to be approximately 157 N when the width dimension of the media M is 1.6 m.

Various mechanisms can be used as the pressure force adjustment mechanism 51, and it is possible to prepare in advance a plurality of pressure rollers 15 with the diameter dimension changed, and to manually replace or to automatically switch these according to the used media M.

Figure 6A:
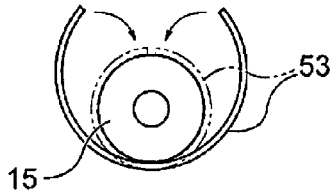
FIGS. 6A-6D are explanatory drawings showing the state of the pressure force adjustment mechanism and the blade action position adjustment mechanism of the liquid discharge device of embodiment 3 of the present invention.
Figure 6B:
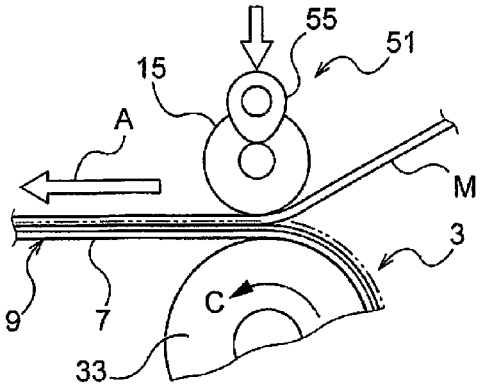
Figure 6C:
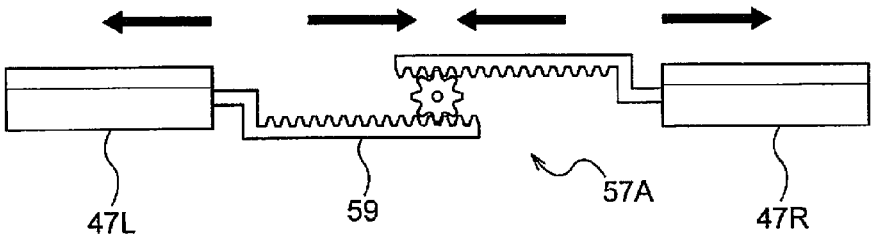

Also, as a mode for changing the diameter dimension of the pressure roller 15, as shown in FIG. 6A, it is possible to change the diameter dimension of the pressure roller 15 by winding a sheet 53 of a designated thickness in the periphery of the pressure roller 15. It is also possible to adjust the pressure force of the pressure roller 15 by changing the position of the pressure roller 15 to be closer and farther in relation to the conveyance belt 9. In this case, it is possible to use the pressure force adjustment mechanism 51 using a cam mechanism 55 or the like such as that shown in FIG. 6B, for example.

Also, with this embodiment 3, the constitution is such that the action position of the left and right blades 47L and 47R (FIG. 3) can be adjusted by a blade action position adjustment mechanism 57. It is possible to use various mechanisms as the blade action position adjustment mechanism 57, and possible as an example to use a mechanism 57A that uses a rack and pinion mechanism 59 or the like such as that shown in FIG. 6C. In the case of this mechanism 57A, it is possible to use this in a case such as when adjusting the coating width of the pretreatment liquid L by simultaneously making the position of the width direction B of the left and right blade 47L and 47R closer and farther corresponding to the media M width dimension or the like.

Figure 6D:
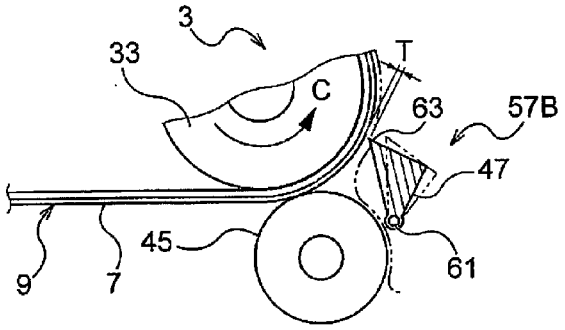

Also, it is possible to use a blade action position adjustment mechanism 57B made to be able to rotate the blade 47 within a designated angle range with a rotation fulcrum 61 as the center as shown in FIG. 6D. In the case of this mechanism 57B, it is possible to use this in a case such as when adjusting the coating thickness of the pretreatment liquid L by changing the gap T between the contact piece 63 of the tip of the blade 47 and the surface of the conveyance belt 9.

Also, with the control unit 29, based on the input information of the used media M or the like, a suitable pressure force of the pressure roller 15 and a suitable action position for the blade 47 are determined, and the pressure force adjustment mechanism 51 and the blade action position adjustment mechanism 57 are driven so as to set the desired pressure force of the pressure roller 15 and the action position of the blade 47.

Also, with the liquid discharge device 1C of this embodiment 3 constituted in this way, it is possible to enjoy the same action and effects as those of the liquid discharge device 1A of embodiment 1 described previously.

Furthermore, with this embodiment 3, by adjusting the pressure force of the pressure roller 15 according to the difference in the media M type, thickness or the like, it is possible to adjust the level of penetration of the pretreatment liquid L into the inside of the media M and the like. Also, by adjusting the action position of the blade 47 according to the difference in the media M width dimension, thickness or the like, it is possible to match the coating width and coating thickness of the pretreatment liquid L, and possible to perform suitable pretreatment.

Figure 7:
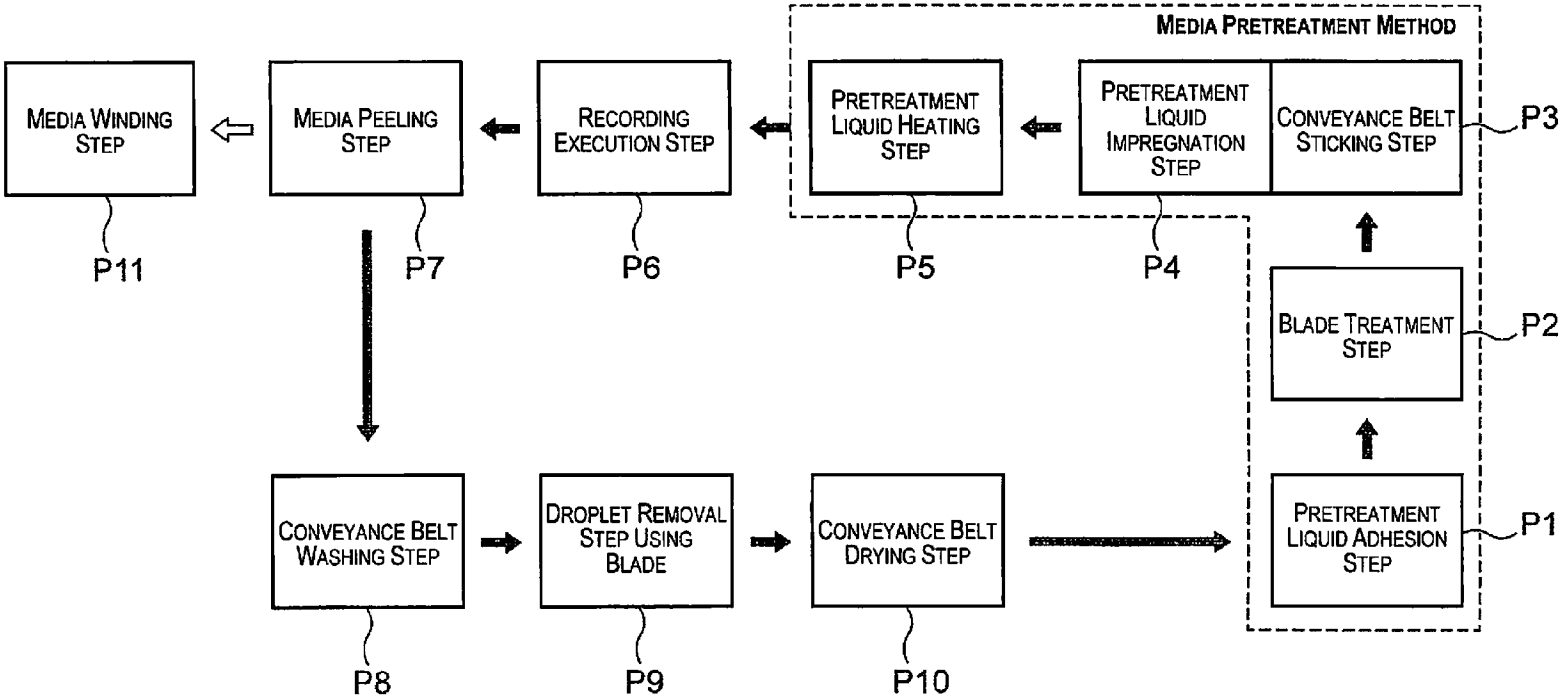
FIG. 7 is a block diagram showing the media pretreatment method of embodiment 4 of the present invention.

Embodiment 4 (See FIG. 7)

The media pretreatment method which is embodiment 4 of the present invention is an item for which when the media M stuck to the surface of the conveyance belt 9 is conveyed and supplied to the liquid discharge area 11, there is a step of sticking the media M using the pressure roller 15 to the conveyance belt 9 in a state with the pretreatment liquid L adhered. Specifically, when the media M is stuck to the surface of the conveyance belt 9, the pretreatment liquid L on the conveyance belt 9 is adhered to the media M, and by adding pressure force from the pressure roller 15 to the media M to which that pretreatment liquid L is adhered, the pretreatment liquid L is made to be impregnated in the media M.

This embodiment 4 is constituted such that in correspondence to the media pretreatment method executed when using the liquid discharge device 1A of embodiment 1 described previously, each step process is executed in sequence according to the flow of each step of the block diagram shown in FIG. 7, for example.

Specifically, with the pretreatment liquid adhesion step P1 as a starting point, the pretreatment liquid L is adhered to the surface of the conveyance belt 9 with this step P1, and at the next blade processing step P2, the pretreatment liquid L is pushed and spread on the surface of the conveyance belt 9.

Next, the conveyance belt 9 moves to the sticking position at which the media M is stuck to the surface, receives the pressure force of the pressure roller 15, and the conveyance belt sticking step P3 and the pretreatment liquid impregnation step P4 are executed simultaneously. Therefore, here, using the two steps P3 and P4, the media M is reliably held on the surface of the conveyance belt 9 in a state with positional skew prevented by being stuck to the conveyance belt 9, the pretreatment liquid L deeply penetrates the interior of the media M, and there is a state in which the action and effects of the pretreatment liquid L can be sufficiently exhibited.

Next, the process shifts to the pretreatment liquid heating step P5, and by heating of the pretreatment liquid L being executed, the series of steps constituting the media pretreatment method of this embodiment ends. Then, with the conveyance belt 9 and the media M, recording is executed on the media M with the next step recording execution step P6, and with the media peeling step P7, the media M is peeled from the conveyance belt 9, and at the next step media winding process P11 it is wound onto the winding unit 25.

Meanwhile, the conveyance belt 9 from which the media M has been peeled faces the conveyance belt washing step P8, goes through the conveyance belt washing step P8 using the washing brush 37, the liquid removal step P9 of the surface of the conveyance belt 9 using the blade 39, and the conveyance belt drying step P10 using the wiping roller 41 and the like, and again reaches the pretreatment liquid adhesion step P1 of the starting point.

Thereafter, by repeatedly executing the processes of each step with the flow of the steps P1 to P11, recording of the full length of the media M or of the necessary length continues.

Also, with the media pretreatment method of this embodiment 4 constituted in this way, the pretreatment liquid L deeply penetrates inside the media M, and in a state with sufficient exhibition of the action and effects of the pretreatment liquid L, that media M is supplied to the recording execution step P6, so good quality recording is stably executed.

Therefore, it is possible to effectively prevent surface recording or the like for which the ink does not reach the back surface of the media M which was a problem in the past when using a penetrant as the pretreatment liquid L.

Embodiment 5 (See FIG. 7)

The media pretreatment method that is embodiment 4 of the present invention is characterized by having a step of sticking the media to the conveyance belt 9 using the pressure roller 15 in a state with the pretreatment liquid L adhered when the media M stuck to the surface of the conveyance belt 9 is conveyed and supplied to the liquid discharge area 11. Specifically, when the media M is stuck to the surface of the conveyance belt 9, the pretreatment liquid L on the pressure roller 15 is adhered to the media M, and by applying pressure force from the pressure roller 15 to the media M to which that pretreatment liquid L has adhered, this is made to impregnate the pretreatment liquid L into the media M.

Other Embodiments

The liquid discharge device 1 and the media pretreatment method of the present invention basically have the constitutions like those described above, but it is of course also possible to modify, omit or the like a part of the constitution within a scope that does not stray from the gist of the invention of this application.

For example, with embodiment 1 or embodiment 3, instead of the coating roller 34 that coated the pretreatment liquid L on the surface of the conveyance belt 9, it is also possible to constitute this to coat the pretreatment liquid L using a brush, a sponge form plate member or the like, or to spray the pretreatment liquid L using air pressure or the like.

Also, with the attachment part 17, when equipped with the function of being able to adjust the coating width or the coating thickness of the pretreatment liquid L, it is possible to omit the blade 47. Also, when simultaneously or consecutively adhering and impregnating the pretreatment liquid L of the same type or different types on both the top and bottom surfaces of the media M, it is possible to arrange one set at a time of the attachment part 17 at both the position described with embodiment 1 and the position described with embodiment 2.

Also, it is possible to use the present invention for a liquid discharge device that is equipped with a so-called line head that does not have the carriage 23 as the liquid discharge unit 19. Here, "line head" is an item with a nozzle row formed along the width direction B that crosses the media M conveyance direction.

The present invention is not limited to the embodiments noted above, and various modifications of the inventions noted in the scope of patent claims are possible, and it goes without saying that those are also included within the scope of the present invention.

Above, we gave a detailed description of the present invention based on specific embodiments. Here, we will describe the present invention again in summary form hereafter.

The liquid discharge device 1 of the first mode of the present invention is equipped with a conveyance belt 9 for sticking media M on an adhesive layer 7 of its surface and conveying it, a pressure roller 15 for sticking media M to the conveyance belt 9, and an attachment part 17 provided at an upstream position to the pressure roller 15 in the movement path 5 of the conveyance belt 9, for adhering a pretreatment liquid L to the conveyance belt 9, wherein the media M is stuck using the pressure roller 15 to the conveyance belt 9 in a state with the pretreatment liquid L adhered.

With this mode, the media M is stuck using the pressure roller 15 to the conveyance belt 9 in a state with the pretreatment liquid L adhered, so when the media M is attached to the conveyance belt 9, it is easier for the pretreatment liquid L on the conveyance belt 9 to penetrate the media M by the pressure force received from the pressure roller 15.

By doing this, for example when that pretreatment liquid L is a penetrant that promotes penetration of liquid into the media M, for example, discharged liquid is pooled on only the surface of the media M for which the effect as that penetrant is sufficiently exhibited, and it is possible to reduce the occurrence of surface recording for which the liquid does not fully reach the back surface of the media M or the like.

Also, with that liquid discharge device 1, the attachment part 17 that adheres the pretreatment liquid L on the conveyance belt 9 is provided at an upstream position to the pressure roller 15 in the movement path 5 of the conveyance belt 9, so greater length and size of the overall device is suppressed and it is possible to realize a more compact size.

The liquid discharge device 1 of the second mode of the present invention is equipped with a conveyance belt 9 for sticking media M on an adhesive layer 7 of its surface and conveying it, a pressure roller 15 for sticking media M to the conveyance belt 9, and an attachment part 17 for adhering a pretreatment liquid L to the pressure roller 15, wherein the media M is stuck on the conveyance belt 9 using the pressure roller 15 in a state with the pretreatment liquid L adhered.

With this mode, the pretreatment liquid L is adhered to the circumferential surface of the pressure roller 15 at the stage before sticking the media M to the surface of the conveyance belt 9, and furthermore, is adhered to the top surface of the media M (surface on the side at which liquid is discharged) when the media M is stuck to the conveyance belt 9. At this time, by the pressure force of the pressure roller 15 acting on the media M, the pretreatment liquid L adhered to the top surface of the media M is made to penetrate into the media M while fully reaching broadly on the surface of the media M.

For example, when that pretreatment liquid L is a coating liquid, the coloring of the liquid discharged on the media M is better, and a vivid image is formed. Meanwhile, when that pretreatment liquid L is a penetrant, the action and effects described with the first mode are obtained.

The liquid discharge device 1 of the third mode of the present invention is the first mode wherein between the attachment part 17 and the pressure roller 15 in the movement path 5 of the conveyance belt 9 is provided a blade 47 that is in sliding contact on the surface of the conveyance belt 9.

With this mode, the blade 47 is in sliding contact with the surface of the conveyance belt 9, so the pretreatment liquid L adhered to the conveyance belt 9 is made to uniformly fully reach the entire surface of the conveyance belt 9. When the media M is attached to the conveyance belt 9 in this state, by receiving pressure force from the pressure roller 15, it is easier for the pretreatment liquid L on the conveyance belt 9 to uniformly penetrate across the entire media M.

The liquid discharge device 1 of the fourth mode of the present invention is the second mode wherein between the pretreatment liquid L adhesion position and the media M sticking position on the circumferential surface of the pressure roller 15 is provided a blade 47 that is in sliding contact on the pressure roller 15.

With this mode, by the sliding contact of the blade 47 on the pressure roller 15 with the liquid discharge device of the second mode, it is possible to have the same action and effects as those of the third mode.

The liquid discharge device 1 of the fifth mode is any mode of the first through fourth modes, wherein at a downstream position to the pressure roller 15 in the movement path 5 of the conveyance belt 9, a liquid discharge unit 19 for discharging liquid on the media M is provided, and between the pressure roller 15 and the liquid discharge unit 19, a heater 49 is provided for heating the pretreatment liquid L adhered to the media M.

With this mode, the pretreatment liquid L impregnated in the media M at the position at which the pressure roller 15 is in contact with the media M is heated until it reaches the liquid discharge area 11 in which the liquid discharge unit 19 that discharges liquid exists, and is fixed in the media M. By doing this, the function as the pretreatment liquid L is effectively exhibited.

The liquid discharge device 1 of the sixth mode is any mode of the first mode through the fifth mode, wherein the pressure force of the pressure roller 15 can be adjusted.

With this mode, it is possible to adjust the pressure force of the pressure roller 15 according to differences in the type, thickness or the like of the media M, and thus it is possible to adjust the degree of penetration of the pretreatment liquid L in the media M and the like.

The liquid discharge device 1 of the seventh mode is the third mode or the fourth mode, wherein the action position of the blade 47 can be adjusted.

With this mode, it is possible to adjust the action position of the blade 47 according to differences in the media M width dimension, thickness or the like, and thus it is possible to match the coating width, coating thickness or the like of the pretreatment liquid L to the media M.

The media pretreatment method of the eighth mode of the present invention is an item which, when media M stuck to a surface of a conveyance belt 9 is conveyed and sent to a liquid discharge area 11, has a step of sticking the media M using a pressure roller 15 to the conveyance belt 9 in a state with pretreatment liquid L adhered.

With this mode, when the media M is attached to the conveyance belt 9, it is easier for the pretreatment liquid L on the conveyance belt 9 to penetrate the media M using the pressure force received from the pressure roller 15.

The media pretreatment method of the ninth mode of the present invention is an item which, when media M stuck to a surface of a conveyance belt 9 is conveyed and sent to a liquid discharge area 11, has a step of sticking the media M to the conveyance belt 9 using a pressure roller 15 in a state with pretreatment liquid L adhered.

With this mode, when the media M is attached to the conveyance belt 9, by the action of the pressure force from the pressure roller 15 on the media M, the pretreatment liquid L adhered to the top surface of the media M via the pressure roller 15 is made to penetrate in the media M while fully extending widely on the surface of the media M.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge device comprising:

a conveyance belt configured to stick a medium on an adhesive layer of a surface of the conveyance belt and convey the medium;

a pressure roller configured to stick the medium to the conveyance belt; and an attachment part provided at an upstream position relative to the pressure roller in a movement path of the conveyance belt, the attachment part being configured to adhere a pretreatment liquid to the conveyance belt, the medium being stuck using the pressure roller to the conveyance belt in a state with the pretreatment liquid adhered, and a pressure force of the pressure roller being adjustable.

2. The liquid discharge device according to claim 1, further comprising a blade arranged between the attachment part and the pressure roller in the movement path of the conveyance belt, the blade being configured to be in sliding contact on the surface of the conveyance belt.

3. The liquid discharge device according to claim 2, wherein an action position of the blade is adjustable.

4. The liquid discharge device according to claim 1, further comprising a liquid discharge unit configured to discharge a liquid on the medium and arranged at a downstream position relative to the pressure roller in the movement path of the conveyance belt, and a heater configured to heat the pretreatment liquid adhered to the medium and arranged between the pressure roller and the liquid discharge unit.

5. A liquid discharge device comprising:

a conveyance belt configured to stick a medium on an adhesive layer of a surface of the conveyance belt and convey the medium;

a pressure roller configured to stick the medium to the conveyance belt; and an attachment part configured to adhere a pretreatment liquid directly to the pressure roller, the medium being stuck on the conveyance belt using the pressure roller in a state with the pretreatment liquid adhered.

6. The liquid discharge device according to claim 5, further comprising a blade arranged between the pretreatment liquid adhesion position and a sticking position of the medium on a circumferential surface of the pressure roller, the blade being configured to be in sliding contact on the pressure roller.

7. A media pretreatment method comprising when a medium that is stuck to a surface of a conveyance belt is conveyed and sent to a liquid discharge area, sticking the medium using a pressure roller to the conveyance belt in a state with a pretreatment liquid adhered, wherein a pressure force of the pressure roller is adjustable.

8. A media pretreatment method comprising:

when a medium is stuck to a surface of a conveyance belt is conveyed and sent to a liquid discharge area, sticking the medium to the conveyance belt using a pressure roller in a state with a pretreatment liquid adhered by an attachment part configured to adhere a pretreatment liquid directly to the pressure roller.

* * * * *